United States Patent [19]

Weir

[11] 3,965,831

[45] June 29, 1976

[54] APPARATUS FOR CUTTING, SELVAGING AND/OR FOLDING SHEET MATERIAL

[75] Inventor: Henry John Weir, Udine, Italy

[73] Assignees: Sheldon P. Behn, Highland Park; Robert M. Behn, Wilmette, both of Ill.; part interest to each

[22] Filed: Aug. 5, 1974

[21] Appl. No.: 494,853

[52] U.S. Cl. ..... 112/121.15; 112/121.29; 112/155

[51] Int. Cl.[2] ..... D05B 33/00

[58] Field of Search ..... 112/121.29, 121.15, 112/155, 203, 121.11, 121.14, 121.12, 10

[56] References Cited

UNITED STATES PATENTS

| | | | |
|---|---|---|---|
| 2,949,760 | 8/1960 | McCartney et al. | 69/44 X |
| 3,345,963 | 10/1967 | Shoaf | 112/121.29 |
| 3,461,825 | 8/1969 | Brown | 112/10 |
| 3,477,397 | 11/1969 | Hawley | 112/121.11 |
| 3,610,186 | 10/1971 | Murdter | 112/121.29 |

FOREIGN PATENTS OR APPLICATIONS

| | | | |
|---|---|---|---|
| 767,431 | 9/1967 | Canada | 112/155 |

*Primary Examiner*—Alfred R. Guest
*Attorney, Agent, or Firm*—Wallenstein, Spangenberg, Hattis & Strampel

[57] ABSTRACT

There is provided a draping conveyor having a narrow upper margin, a flatwork piece feeding means for feeding sequentially flatwork pieces to a draping station, and flatwork piece engaging means for engaging the flatwork piece at the draping station and pushing a portion thereof over the top of the narrow margin of the conveyor as the feeding means continues to operate, so the flatwork piece is draped over the conveyor with a fold located on one side thereof and the confronting portions thereof extending from the fold depending and both exposed on the other side of the conveyor. The draping conveyor is moved first to a sewing station on the opposite sides of which sewing machines are positioned so operators can readily grasp the exposed end portions of the flatwork piece delivered thereto and apply the same to their sewing machines simultaneously. The flatwork pieces fed sequentially to the draping station are formed from the unwound portion of a roll of flatwork piece forming material which is carried by said feeding means past a severance station. The feeding means is momentarily stopped to allow a severing means to move across the flatwork piece forming material to sever a flatwork piece from the end of the unwound portion of the roll of such material.

10 Claims, 13 Drawing Figures

APPARATUS FOR CUTTING, SELVAGING AND/OR FOLDING SHEET MATERIAL

BACKGROUND OF THE INVENTION

This invention relates to a method and apparatus for mass producing selvege sheet products and has its most important application in the manufacture of bed sheets, bed spreads, blankets, curtains, drapes and other similar flatwork pieces.

Bed sheets, bed spreads and the like have been heretofore made in a manner which was very inefficient because of the manner in which the individual sheets cut from a roll of such material were handled during the various selveging and folding operations performed thereon. Thus, in the prior art, it was the common practice to cut the individual sheets or the like to size from a roll of such material and thereafter stack the cutoff sheets, deliver them to a sewing station with an orientation so the cut edges run longitudinally thereof, where these edges can be more conveniently manually sewed in sequence on the same sewing machine and then manually fold and deliver them to packaging machinery.

In addition to the fact that the sheets were generally moved and handled manually at each stage in the manufacturing and folding process involved, the slowest and perhaps the most inefficient operation in the entire manufacturing process occurred at the sewing station where the cut edges are selvaged (i.e. folded and stitched). The speed of sewing machines has until recent years been severly limited. Recently, however, sewing equipment has been developed which operate at a speed of 7,000 stitches per minute but even on these high speed machines the maximum lineal speed that the sheets can be fed through such sewing machines is approximately 50 feet a minute, which is about one third the speed of operation of automatic folding machines presently used in laundries to fold sheets thereon. The effective lineal feed rate during the sewing operation was reduced by a factor of two because only a single sewing machine was used at a time on a sheet which had its opposite raw cut margins fed manually in succession through the the same sewing machine. This, of course, required a great deal of manual material handling by the sewing operator. While one may conjecture that the sewing period could be cut in half by using two machines simultaneously sewing selvaged edges or hems at the opposite sides of each sheet, there is a problem of synchronizing the simultaneous handling of the opposite edges of a single sheet of material by separate operators folding and feeding the same sheet through separate sewing machines. Thus, if one operator at one side of a table upon which the sheet is supported and fully opened moves the folded edge of the sheet through a sewing machine at a different instant or at a different speed, the sheet is pulled or stretched so the sewing operation cannot be properly carried out. Also, if the table should uniquely be part of an intermittently moving conveyor which is momentarily halted to permit a sewing operation, the conveyor cannot be moved until both operators have completed their sewing operations, and so a conveyor dwell period must be set which assures the slowest possible sewing time.

SUMMARY OF THE INVENTION

In accordance with one of the features of the invention, sheets cut from a roll of the material involved, instead of being manually stacked for subsequent manual delivery to a sewing station or a folding station where the cut edges need not be selvaged, are received sequentially automatically upon intermittently moving conveyor equipment which supports the same in juxtaposed relation ready to be sewed or folded in succession. Most advantageously, the sheets are folded in half and draped over the narrow upper margin of a belt or other conveyor (sometimes referred to as a draping conveyor) extending transversely to the direction of movement of the sheet material from the roll. The cutting and draping operations and subsequent movement of the draping conveyor are preferably automatically controlled. Thus, when an infeeding conveyor which delivers the sheet to the draping conveyor delivers the leading edge thereof to a leading edge sensing device, the cutting operation is carried out a fixed distance behind this point and the severed sheet is dropped or pushed over the narrow upper margin of the draping conveyor.

In accordance with another feature of the invention where 9 hemming or selvaging operation is to be performed, the sheet draping conveyor is stopped in front of a sewing station on the opposite lateral sides of which sewing machines with operators are located. The upper portion of each draped sheet is preferably immovably held against the narrow upper margin of the conveyor, and each operator picks up the front portion of the bottom cut edge of the sheet on her side of the station, makes a few small folds in the bottom thereof, makes an end stitch with a stitching machine and then feeds the folded and end stitched margin a short distance through the same or different sewing machine where a longitudinal stitching operation is initiated. The operator on the opposite side of the sewing station performs the same operations, but her operations will probably be completed at a different time than that of the first mentioned operator. Because each sheet is supported so that the opposite lateral sides thereof hang downwardly over the sheet draping conveyor, each bottom cut edge portion of each side of the draped sheet can swing freely of the other side for a limited distance without disturbing the position of the upper portion of the draped sheet. (This is not possible with the sheet of material supported on a flat surface since a movement of the front of one side will create a movement or a distortion of the material on the other side.) When both folded and end stitched edges of the sheet are moved the same distance through the sewing machines, sensing means are operated to initiate movement of the draping conveyor to complete the feed of the sheet through the machines whereupon the conveyor again is stopped for completion of the final end stitched.

An important advantage of draping the sheets on the draping conveyor in addition to performing a fold in the sheets and the convenience of permitting simultaneous sewing operations, is that the sheets can be conveniently inspected by the sewing operators or other inspectors who can obtain a good view of both sides of the sheets.

Another feature of the invention is the manner in which the draped sheets are fed into a folding machine where another fold is made in the same direction as the first mentioned fold by a folding blade which pushes the once folded draped sheet into the mouth of clamping means which then pulls the same off of the draping conveyor to complete a second fold. The folding machine can then perform cross-folding operations.

In accordance with still another feature of the invention, since the sewing operation is a slower operation than the subsequent lateral and cross-folding operations a single folding machine having inlet stations on opposite sides thereof can be positioned between a pair of draping conveyors fed from separate infeeding conveyors delivering cut pieces of the sheet material unwinding from separate rolls thereof. The inlet station of the folding machine receives in sequence the sheets fed to the opposite lateral sides thereof from the draping conveyor. Such a folding machine is unique because conventional folding machines receive flatwork at one end and deliver folded flatwork to the other end thereof, while the just described folding machine receives sheets in sequence at the opposite lateral sides thereof and delivers folded sheets to a common delivery station.

Refer now to the drawings which illustrate an exemplary sheet cutting, draping, sewing and folding system incorporating the various features of the invention above described. In these drawings:

DESCRIPTION OF THE PREFERRED EMBODIMENTS OF THE INVENTION

Figure 1:
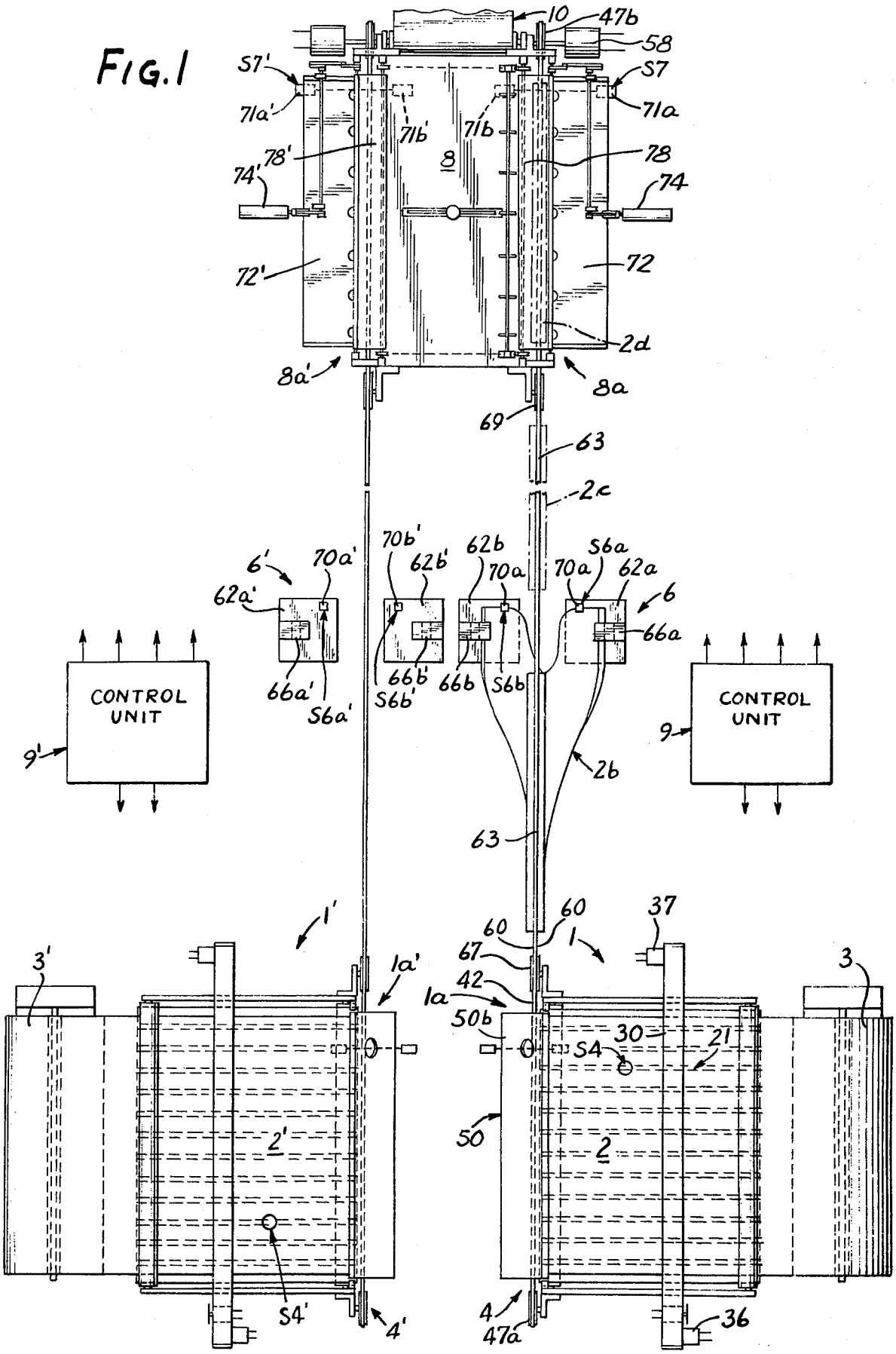
FIG. 1 is a plan view of the system, partly broken away.

Referring now more particularly to FIG. 1, the apparatus thereshown includes a pair of sheet cutting and sheet draping units 1–1′ having sheet material 2–2′ unwinding from rolls 3–3′ of such material severed by cutting apparatus to be described, and draped on draping conveyors 4–4′ extending transversely away from draping stations **1*a*–1*a*′ of the sheet cutting and sheet draping units 1–1′. The draping conveyors 4–4′, are intermittently moved respectively first to sewing stations 6–6′ where the raw edges of the individual sheet pieces are selvaged or hemmed, and then to laterally opposite facing inlet stations 8*a*–8*a*′ of a common folding unit 8. The sheet pieces are fed sequentially into the inlet station 8*a*–8*a*′ of the folding unit 8 and delivered in a completely folded state to a common outlet conveyor 10** which may extend to a packaging station (not shown).

The operation of the draping conveyor and the apparatus at the various stations, except perhaps the sewing machines at the sewing stations, are under control of sheet and apparatus position sensing means to be described, in turn, forming part or extending to control units 9 and 9′. The details of the control units 9 and 9′ are not disclosed herein, since logic circuits which can satisfy the various interrelated operating conditions to be described are well known.

One aspect of the invention deals with the unique interrelationship of a pair of sheet cutting and draping units like 1–1′ and their associated draping conveyors 4–4′ uniquely extending to the opposite lateral facing sides of a common folding unit 8. However, various aspects of the invention are useful with a single sheet cutting and draping unit 1 and associated draping conveyor 4. While one of the important specific aspects of the invention deals with the unique way in which the sheet material pieces are delivered to a sewing station, namely in a draped condition for reasons previously explained, several aspects of the invention have utility when the sheet pieces do not have to be fed to a sewing station, because of the unique and efficient manner in which the sheet material pieces are automatically handled and folded during the movement thereof from the roll 3 to the outlet conveyor 10.

Figures 2, 3, 4, 5, 6, 7:
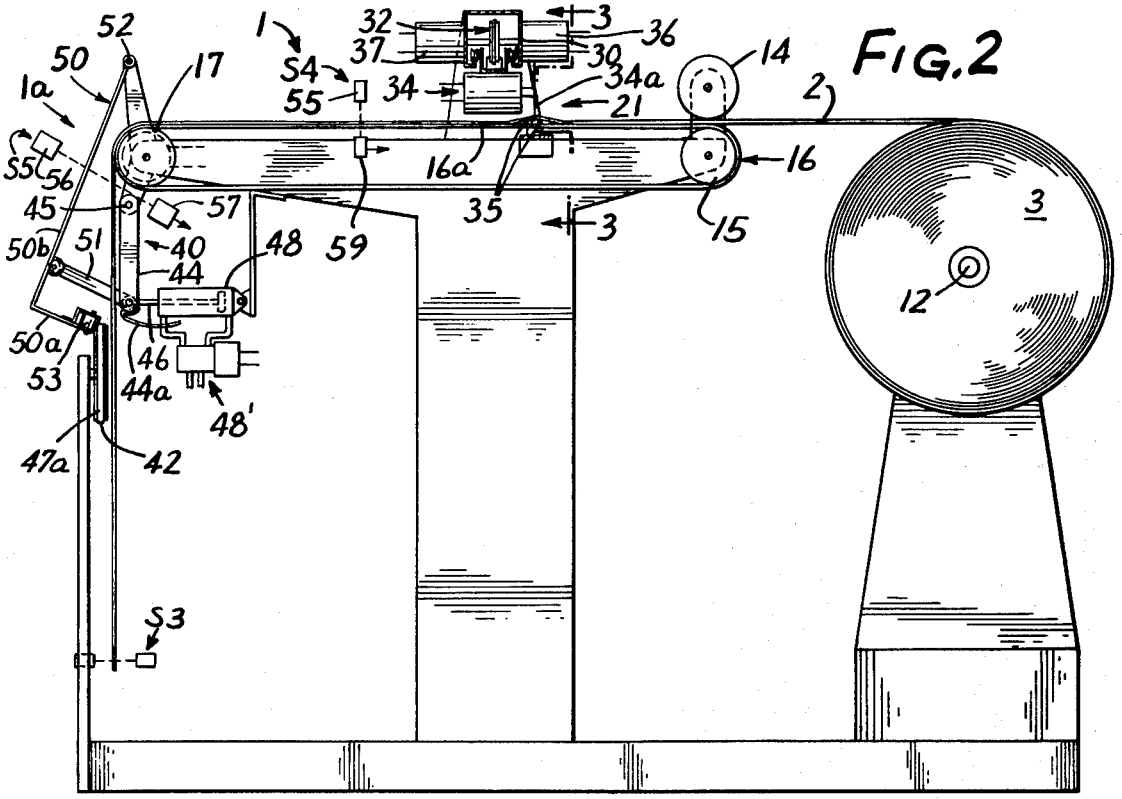
FIG. 2 is a side elevational view of one of the two identical sheet cutting and draping units forming part of the system shown in FIG. 1.
FIG. 3 is a transverse section through the sheet cutting and draping unit shown in FIG. 2, taken along section line 3—3 therein.
FIG. 4 is a fragmentary view of a portion of the unit shown in FIG. 2, where the sheet is being draped by a sheet pushing means over a draping conveyor extending transversely from the sheet cutting and draping unit.
FIG. 5 is a view of the portion of the apparatus shown in FIG. 4 where the sheet pushing means has been returned to its inoperative retracted position.
FIG. 6 is a view corresponding to FIG. 5 as the end of the cut sheet shown in FIGS. 4 and 5 is dropping off of the conveyor of the sheet cutting and draping unit.
FIG. 7 is a view corresponding to FIG. 6 after the end of the sheet shown in FIG. 6 has dropped into its first position on the draping conveyor.

Refer now more particularly to FIGS. 2–6 which illustrate the construction and mode of operation of the sheet cutting and draping unit 1, it being understood that the sheet feeding and draping unit 1′ operates in the same manner and has the same construction as the unit 1 now to be described. Thus, as shown in FIG. 2, the roll 3 of sheet material is mounted upon an undriven rotatable shaft 12 extending laterally and horizontally of the unit 1 and unwinds from the roll 3 to pass between an upper roller 14 and endless belt means 16 preferably comprising laterally spaced narrow belts extending within grooves in drums 15 and 17. One of the drums is driven by suitable motor means 19 or the like intermittently energized to effect a step by step movement of the sheet material 2 in a manner to be described. The upper sections **16*a* of the narrow endless belts impart a pulling force on the sheet material 2 at a point beneath the roller 14, to advance the sheet material to a sheet cutting station 21**.

At the sheet cutting station 21, there is provided a housing 30 in which extends a transversely extending endless conveyor means 32, whose lower section **32*a*** carries a sheet cutting unit 34. The endless conveyor means 32 extends around end sprockets 31–33 to which drive motors 36–37 are respectively coupled. When drive motor 36 is energized, the endless conveyor means 32 carries cutting unit 34 from left to right as viewed in FIG. 3, and when the motor 37 is energized the endless conveyor means carries the cutting unit 34 from right to left as viewed in FIG. 3.

The cutting unit 34 may include a circular cutting wheel 34*a* extending in a plane transversely of the direction of movement of the sheet material past the cutting station 21. The bottom end of the cutting wheel is positioned slightly above the level of the narrow conveyor belts forming the endless belt conveyor means 16, and groups of sheet material raising fingers 35—35 extend up between these narrow belts at points on opposite sides of the path of movement of the cutting wheel 34*a*, to raise the sheet material in the vicinity of the cutting wheel so the cutting wheel can cut through the sheet material as it is moved from one side to the other of the sheet cutting and draping unit 1. When the cutting unit 34 moving transversely above the endless belt conveyor means 16 reaches one limit of its path of travel at one side thereof, a limit switch or other sensing means S1 operates to terminate energization of the associated motor 36, and when the cutting unit 34 returns to a position at the opposite side of the endless belt conveyor means it operates a limit switch or other sensing means S2 to terminate energization of the associated motor 37. The energization of the motor 36 or 37 is partly under control of a sensing means S3 positioned at a point substantially below the end of the endless belt conveyor means 16.

As seen in FIG. 2, when the endless belt conveyor means 16 moves the yet unsevered sheet material to a point where the leading end thereof drops vertically to a point opposite the sensing means S3 (which may be a horizontally oriented light source 41 and a photocell control unit 43) the movement of the endless belt means comes to a halt as the motor 19 becomes deenergized, and the cutting unit control motor 36 or 37 becomes energized to initiate movement of the cutting unit 34 to the opposite side of the endless belt conveyor means 16 to sever the sheet material 2. When the cutting unit reaches such opposite side of the endless belt conveyor means and operates the associated sensing means S1 or S2, in addition to the resulting deenergization of the motor 36 or 37 the motor 19 controlling the movement of the endless belt conveyor means becomes energized which starts the same, and sheet pushing means 40 operates to push the portion of the sheet material 2 on top of the draping conveyor 4 as best shown in FIG. 4.

In the exemplary form of the invention illustrated, the sheet pushing means 40 includes a pair of generally vertically extending arms 44—44 positioned at opposite sides 4 and below the endless belt conveyor means 16. The upper ends of the arms 44—44 are shown pivoted at 45—45 (FIGS. 2–3) and the bottom ends thereof are connected to a piston rod 46 of an air or hydraulic cylinder 48 controlled by a solenoid control valve 48' which when energized effects outward movement of the piston rod 46. When the piston rod 46 is retracted as shown in FIG. 2, a pressure-applying assembly 50, preferably secured by a links 51 to the sheet pushing arms 44—44, is in a pressure applying position, where rollers 53 carried on the end portion 50*a* thereof engage the draping conveyor at spaced intervals along a length of the draping conveyor. As illustrated, the end portion 50*a* of the pressure applying assembly 50 extends from an operating arm 50*b* pivoted about a pivot axis 52. When the sheet pushing arms 44—44 are moved forwardly, the rollers 53 are removed from contact with the draping conveyor 4 to an extent which permits the sheet pushing members to push and drape a portion of the sheet material over the draping conveyor (see FIG. 4) while the draping conveyor is stationary. Spring means 44*a* carried on the bottom of the arms 44—44 apply pressure to the sheet material to hold the same in place on the draping conveyor 4 as a fold 54 is formed in the sheet material, as best shown in FIG. 4.

As illustrated, the draping conveyor 4 may comprise a V-belt 42 extending around grooved wheels 479–47*b*. As shown in FIG. 1. The grooved wheel 47*a* is driven by a motor 58 which is intermittently operated preferably to effect a fixed degree of movement of the draping conveyor, which degree of movement is preferably a distance somewhat greater than the dimension of the draped severed piece of sheet material measured parallel to the direction of movement of the draping conveyor 4. The sewing station 6 is spaced one or more times this basic distance from the draping station 1*a*, and the inlet station 8*a* of the folding unit is preferably spaced two or more times this basic distance from the sewing station.

While the sheet pushing arms 44—44 are in their sheet draping position, as the sheet material 2 continues to drop the point at which the fold 54 is located along the length of the severed piece of sheet material will vary. When this point is approximately midway of the length of the severed piece of sheet material, the trailing edge of the severed sheet still riding on top of the upper section of the endless belt conveyor means 16 leaves a sensing means S4 which is illustrated as comprising a downwardly directed light source 55 and a photocell control unit 59. The receipt of the light beam by the photocell control unit 59 at this point in the operation of the system results in de-energization of the solenoid control valve 48' which retracts the piston rod 46 and the sheet pushing arms 44—44, so that further downward movement of the sheet material will cause the sheet material to drop vertically downwardly until the sheet material leaves contact with the endless belt conveyor means 16 and finally assumes the position shown in FIG. 8, where the draping operation is completed. When the sheet pushing arms 44—44 are retracted, the rollers 53 of the pressure applying means will then make engagement with the draped over end of the sheet 2 shown in FIGS. 4–8, to hold the same upon the draping conveyor 4.

When the sheet material 2 drops from the endless belt conveyor means 16 sensing means S5, which is illustrated as comprising a light source 56 and a photocell control unit 57 located just below the end of the endless belt conveyor means 16, will sense the passage of the dropping severed end of the piece of sheet material involved and generate a control pulse which deenergizes the motor 19 to stop the endless belt conveyor means 16.

Intermittent movement of the draping conveyor 4 is controlled by the slowest operating portion of the sheet cutting, draping, sewing and folding system, which in the exemplary embodiment of the invention is the sheet selvaging operation performed at the sewing station 6. When the sewing station 6 generates a signal indicating completion of the selvaging operation thereat, the draping conveyor 4 is move the fixed direction referred to, and the endless belt conveyor means motor 19 is energized, whereupon the cycle of operation of the cutting and severing unit 1 just described will repeat itself, as the leading edge of the unsevered sheet material once again interrupts the beam of the sensing means S3. It should be recalled that the draping conveyor 4 moves a fixed distance equal to somewhat greater than the length of each draped piece of sheet material. The speed of this movement is such that a draped sheet is moved away from the draping station 1*a* of the sheet cutting and draping unit 1 before the leading edge of the sheet material 2 unwinding from the roll 3 can reach and interfere with the draped piece of sheet material moving away from the draping station 1*a*.

While the draping operation is disclosed as an operation where the upper end portion of a folded-in-half piece of sheet material extends over one side of the draping conveyor, with the confronting outer end portions thereof extending on the opposite side of the draping conveyor 4, it should be understood that other draping configurations may be utilized (such as a draping operation where the opposite halves thereof extend on opposite sides of the draping conveyor). However, it should be appreciated that the draping method shown in the drawings has the important advantage that the sheets can be easily removed from the draping conveyor by simply pulling the same therefrom.

The draping conveyor 4' receiving once folded and draped pieces of sheet material from the sheet cutting and draping unit 1' acts in the identical manner as draping conveyor 4, and the apparatus now to be described acting on the draped sheets carried by draping conveyor 4 between draping station 1*a* and the inlet station 8*a* of folding unit 8 is duplicated between the draping station 1*a'* of the unit 1' and the inlet station 8*a'* of the folding unit, and corresponding components of such apparatus are similarly numbered in the drawings with an addition of a prime (') to the components associated with draping conveyor 4'.

Figure 8:
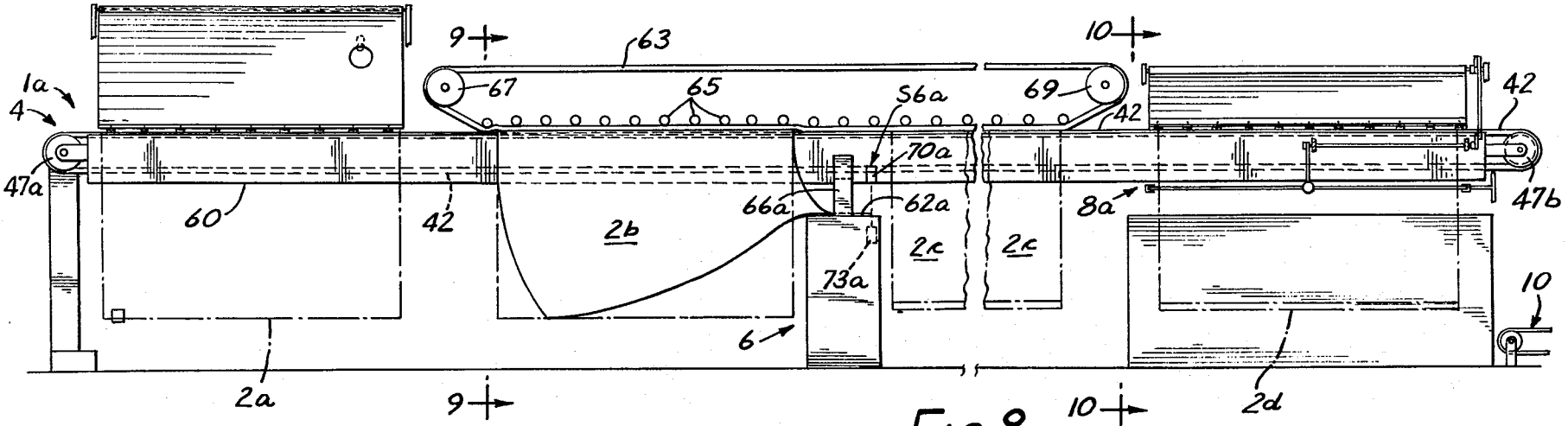
FIG. 8 is a side elevational view of one of the two draping conveyors of the system of FIG. 1 and the sewing and folding stations positioned therealong.
Figure 9:
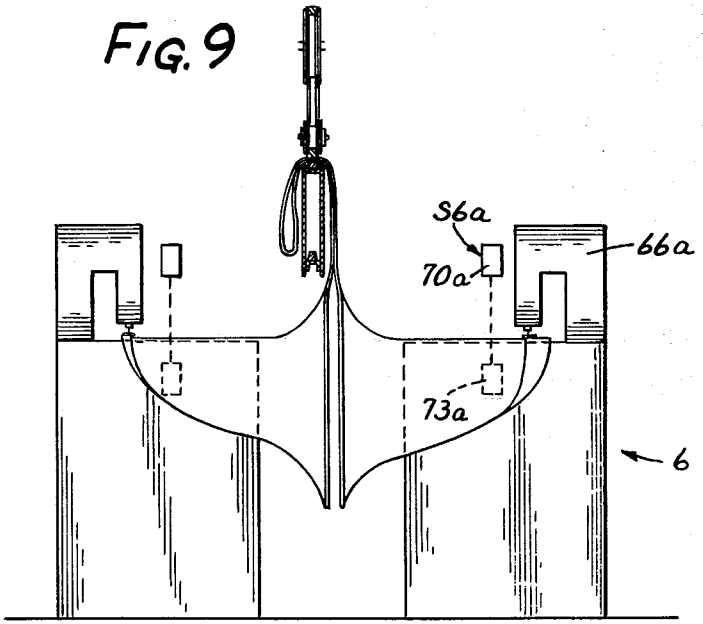
FIG. 9 is a transverse sectional view through the draping conveyor unit shown in FIG. 8, taken along section line 9—9 therein.

Refer now to FIGS. 1 and 8. As thereshown, metal skirt 60 covers the V-belt 42 of the draping conveyor 4 for substantially its full length, and the opposite confronting portions of each draped piece of sheet material 2 extend on the same side of one of these skirts. When a draped piece of sheet material moves away from the draping station upon the draping conveyor 4, it moves beneath the bottom section of an endless belt 63 extending around end rollers 67–69 and beneath bottom rollers 65 located immediately above the upper section of the V-belt 42 of the draping conveyor 4.

When the front edge of a draped piece of sheet material reaches the inlet side of the sewing station 6 (which is spaced from the draping station 1*a* one or more times a basic distance greater than the length of the draped piece of sheet material) the draping conveyor 4 comes to rest. (Such a momentary movement of the draping conveyor 4 can be accomplished in any one of a number of ways well-known in the art of motor control, such as by use of one revolution rotating cams controlling contacts which operate the draping conveyor motor 58).

The sewing station 6 has a pair of sewing tables 62*a* and 62*b* at opposite sides of the draping conveyor 4, and operators are respectively stationed at these tables at positions where they can conveniently grab already longitudinally stitched trailing edges of the draped piece of sheet material 2*c* immediately beyond (i.e. at the outlet end of) the sewing station, and the not yet stitched leading edges of the draped piece of sheet material 2*b* at the inlet end of the swing station 6. The sewing tables 62*a* and 62*b* have sewing units 66*a* and 66*b* thereon. The operators roughly at approximately the same time, but not necessarily in exact synchronism, may first form end stitches in the trailing end of the already longitudinally and front end stitched piece of sheet material 2*c* with sewing machines 66*a* and 66*b* (or a different machine for this purpose) and then form the necessary folds in the bottom edges of the confronting halves of the not yet stitched piece of sheet material 2*b* and apply the folded portion to the associated sewing machines 66*a* and 66*b* (or a different machine for this purpose) to form an end stitch in a well known manner. Because the sheet material being handled by the operators is draped and held in place at the top thereof, each half of the draped piece of sheet material can be readily swung appreciably forwardly and backwardly independently with respect to the other half without any difficulty or interference. The formation or maintenance of the desired fold in the bottom edge of the piece of sheet material involved prior to its being applied or while it is applied to a sewing machine involved is not here described in detail, since conventional techniques, fixtures and the like can be used for this purpose.

After forming the end stitches, the operators then move the folded edges of the piece of sheet material 2*b* involved into the sewing machines 66*a* and 66*b* which initiates a longitudinal stitching operation. As each operator pushes the sheet material a given limited distance into the sewing machines, the leading edges of the portion of the sheet material being handled passes by a sensing means S6*a* or S6*b* comprising a light unit 70*a* or 70*b* directing a beam downwardly towards a photocell control unit 73*a* or 73*b*. When the light beams associated with the sensing units S6*a* and S6*b* on opposite sides of the draping conveyor at the sewing station 6 are both interrupted, the photocell control units initiate energization of the conveyor motor 19 of the sheet cutting and draping unit 1 and effect another momentary energization of draping conveyor motor 58 for a time interval which moves the draping conveyor said fixed distance. A new cycle of operation at the sewing and draping stations is then initiated as described. As the draping conveyor 4 moves during such time interval, a longitudinal stitch is completed over the full length of the piece of sheet material 2*b* and a hemmed piece of sheet material like 2*c* is moved to the inlet station of folding unit 8.

Figure 10:
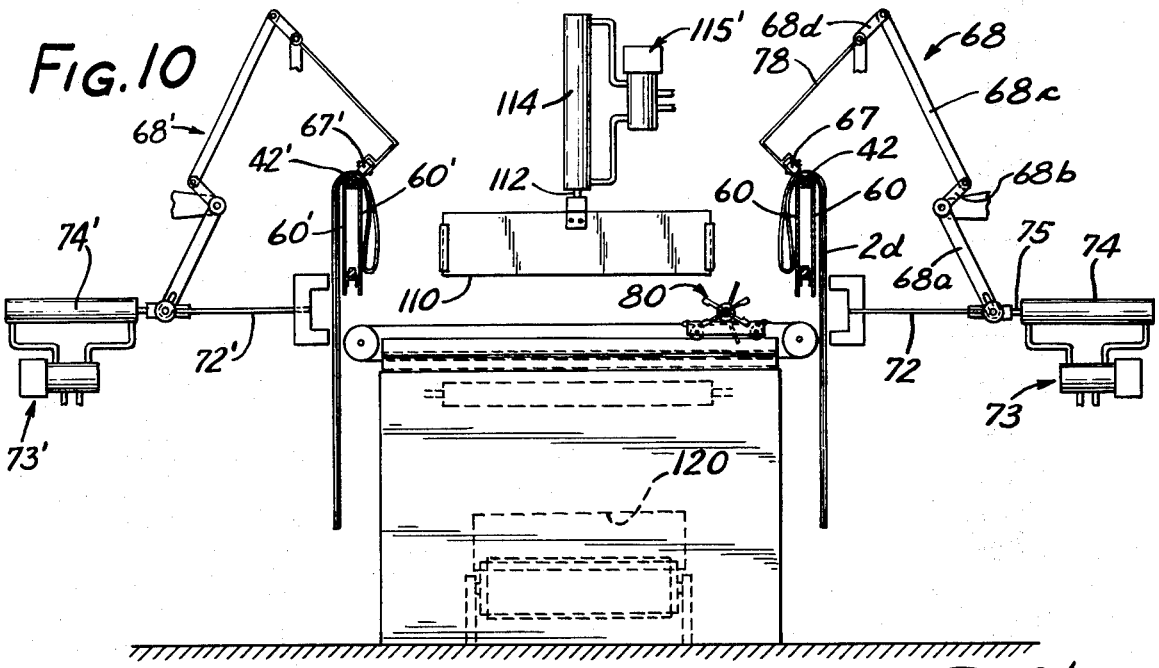
FIG. 10 is a transverse sectional view through the end of the draping conveyor shown in FIG. 8, taken along section line 10—10 therein.

As the latter piece of sheet material leaves contact with the bottom section of the endless pressure applying belt 63, it moves under the rollers 67 (FIG. 10) of pressure applying apparatus generally indicated by reference numeral 68 to be later described. The rollers 67 hold the draped piece of sheet material securely in place on the draping conveyor 4 during its movement opposite the inlet station of the folding unit 8.

When the draped and sewed piece of sheet material reaches the inlet station of the folding unit 8, a sensing means S7, which may comprise a light source 71*a* directing light horizontally to a photocell control unit 71*b*, senses the presence of the piece and generates a signal which, as illustrated, closes a solenoid control valve 73 controlling pressure to a cylinder 74, provided a clamping unit 80 is in position opposite the inlet station to receive the same and there is no piece of sheet material to be first cross-folded in the upper portion of the folding unit. The cylinder 74 has a piston having a rod 75 carrying a movable folding blade 72 which is moved against the sheet material to bring the same within the jaws of the clamping unit 80.

As the folding blade 72 is moved forwardly, the pressure applying apparatus 68 is moved into a position which removes the pressure applying rollers 67 from contact with the piece of sheet material at the inlet station of the folding unit 8. As illustrated, pressure applying apparatus 68 includes links 68*a*, 68*b*, 68*c* and 68*d* (FIG. 10) terminating in a pivoted plate 78 carrying the rollers 67. Link 68*a* is connected to the piston rod 75 and when the piston is moved in a direction to bring the blade 72 against the piece of sheet material at the inlet station 8*a* of the folding unit 8, this link moves in a direction which moves the rollers 67 away from the sheet material.

In the exemplary form of the invention being described, the aforesaid clamping unit 80 is an assembly secured between roller-carrying channel members 81—81 (FIG. 12) which ride upon tracks 83—83 permitting movement of the clamping unit 80 between the inlet stations 8*a* and 8*a'* on opposite sides of the folding unit 8. The purpose of the clamping unit 80 is to receive a fold in the sheet material caused by the movement of the blade 72 or 72' within initially open clamp jaw members which shut to tightly engage the fold so formed in the piece of sheet material. The clamping unit then moves to the opposite end of the folding unit 8 to pull the just partially folded piece of sheet material from the draping conveyor 4 or 4' and arrange the same in a horizontal position above a portion of the folding unit at which a cross fold is next to be formed. The clamping unit 80 alternately pulls the pieces of sheet material off the draping conveyors 4 and 4'. The particular position of the clamping unit 80 at one side or the other of the folding unit 8 is sensed by any suitable sensing means, such as by microswitches S8 and S8', which can be positioned at convenient points, such as at the ends of one of the tracks 83.

Figure 12:
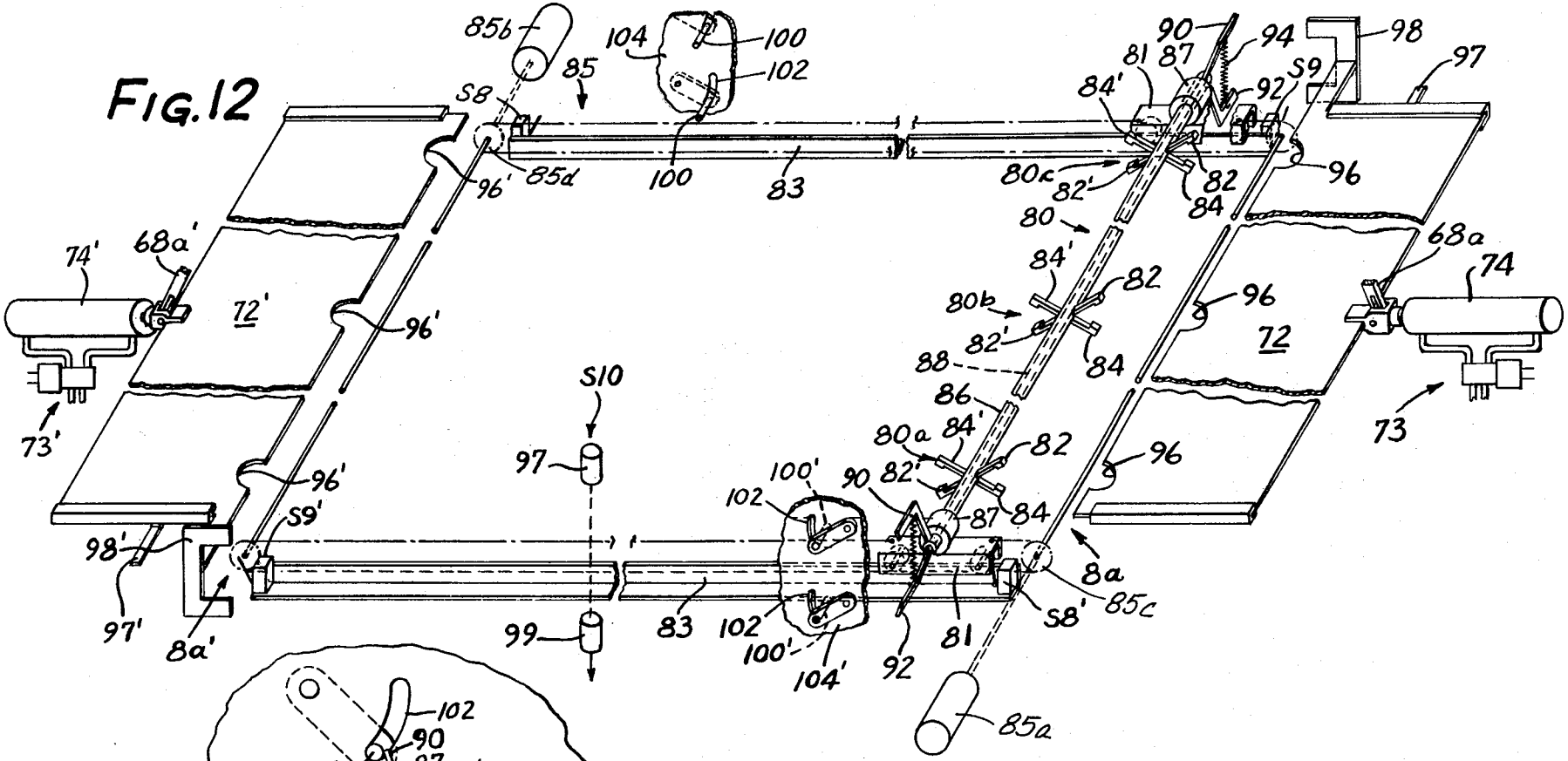
FIG. 12 is a perspective view of the sheet clamping unit forming part of the folding machine shown in FIGS. 8–11.
Figure 13:
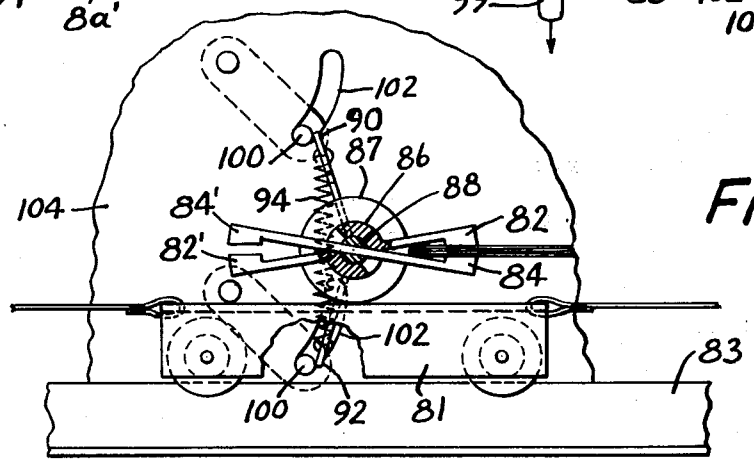
FIG. 13 is a transverse sectional view through the sheet clamping unit shown in FIG. 12, just before reaching apparatus for opening the clamping unit.

While the particular constructional details of the clamping unit 80 form no part of the present invention, an exemplary embodiment thereof will now be described as illustrated in FIGS. 12 and 13. Thus, the clamping unit 80, as shown, has three clamping jaw assemblies 80*a*, 80*b* and 80*c* spaced longitudinally along the clamping unit 80 which extends transversely between the tracks 83—83. Each of the clamp assemblies comprises clamping jaw members 82–82' projecting in opposite radial directions from an outer sleeve 86 and a pair of clamping jaw members 84–84' extending in opposite radial directions from a rod 88 rotatably mounted within the sleeve 86. The sleeve 80 is rotatably mounted within bearings 87—87 supported upon the roller carrying channel members 81—81. The sleeve 86 as well as the rod 88 project beyond the bearings 87—87 and respectively terminate at the opposite ends thereof in pairs of operating arms 90–92 and 90'–92' interconnected by springs 94—94. Springs 94—94 bias the arms 90–92 and 90–92 respectively in either one over-the-center or an opposite over-the-center position. In one of these over-the-center positions, the arms 90–92 and 90–92 are biased into a position where the pairs of clamping jaw members 82–84 and 82'–84' projecting in opposite lateral directions from the clamping unit are respectively closed, to grip the piece of sheet material fed therebetween before the closure thereof, and in the opposite over-the-center positions of the arms 90–92 and 90–92 the clamping jaw members 82–84 and 82'–84' are in their open positions. When the clamping unit 80 is initially in a position opposite one of the inlet stations 8*a* or 8*8'*, these clamping jaw members are in their open positions so that the forward movement of the adjacent folding blade 72 or 72' against the piece of sheet material draped on the associated draping conveyor 4 or 4' brings the piece between the clamping jaw members 82–84 of the various clamping jaw assemblies 80*a*, 80*b* and 80*c*. The front edges of the folding blades 72 and 72' are notched at 96 and 96' to provide clearance for closure of the clamping jaw members. When folding blade 72 or 72' has been moved to its most extended position, an actuator member 98 or 98' carried by the blade 72 or 72' will engage the spring biased arms 90–92 or 90'–92' to push the same into an opposite over-the-center position, to close the clamping jaw members, which are free to close because of the notches 96 and 96' in the folding blades 72 and 72'.

The clamping unit 80 is moved from one inlet station 8*a* to the other inlet station 8*a'* by any suitable conveyor means, such as the endless conveyor means 85 illustrated in FIG. 12. The conveyor means 85 is controlled by suitable motors 85*a* and 85*b* respectively coupled to opposite end sprockets 85*c* and 85*d*. When motor 82*a* is energized, the endless conveyor means 82 will move the clamping unit 80 from inlet station 8*a* and the inlet station 8*a'*. The particular motor 82*a* or 82*b* which is energized at any given time depends upon whether the sensing switch S8 or S8' senses the presence of the clamping unit 80. Thus, if sensing unit S8 senses the presence of clamping unit 80 adjacent the inlet station 8*a*, the motor 85*a* will become energized as a control arm 97 movable with the folding blade engages a microswitch S9 when the folding blade 72 is in its fully extended position. Similarly, if the sensing means 88 senses the presence of the clamping unit 80 adjacent inlet station 8*a'*, the motor 85*b* connected to end sprocket 85*d* will become energized as soon as the folding blade 72' is moved into an extended position where a control arm 97' movable with the folding blade 72' engages a microswitch S9'. The return movement of the folding blades to their initial position and the de-energization of the motors 85*a* and 85*b* are effected by operation of contacts of the microswitches S8–S8' and S9–S9'.

When the clamping unit 80 has pulled a piece of sheet material into its proper horizontal position in the folding unit preparatory to a cross folding operation, a sensing unit 10 which may comprise a downwardly directed light source 97 and a photocell control unit 99, senses the presence thereof and inhibits operation of the folding blades 72 and 72'. Also, spring biased arms 90–92 or 90–92' will be moved against pins 100—100 or 100'—100' which move the spring biased arms 90–92 or 90–92 into their opposite over-the-center position to open the clamping jaw members 82–84 or 82'–84. The pins 100—100 operate to open the associated clamping jaw members when the clamping unit 80 is moved into a position opposite the inlet station 8*a'*, and the pins 100'—100' are operated to open the clamping jaw members when the clamping unit 80 is moved opposite the inlet station 8*a*.

As illustrated, the pins 100—100 and 100'—100' may be respectively carried on the ends of pivoted links 101—101 and 101′—101′. The pins 100—100 and 100′—100′ pass through guide slots 102—102 and 102′—102′ in stationary walls 104—104′, so that the pins 100—100 and 100′—100′ can be pivoted out of the way without disturbing the spring biased arms 90–92 and 90–92 when the clamping unit 80 is moved away from a given inlet station 8*a* or 89′.

Figure 11:
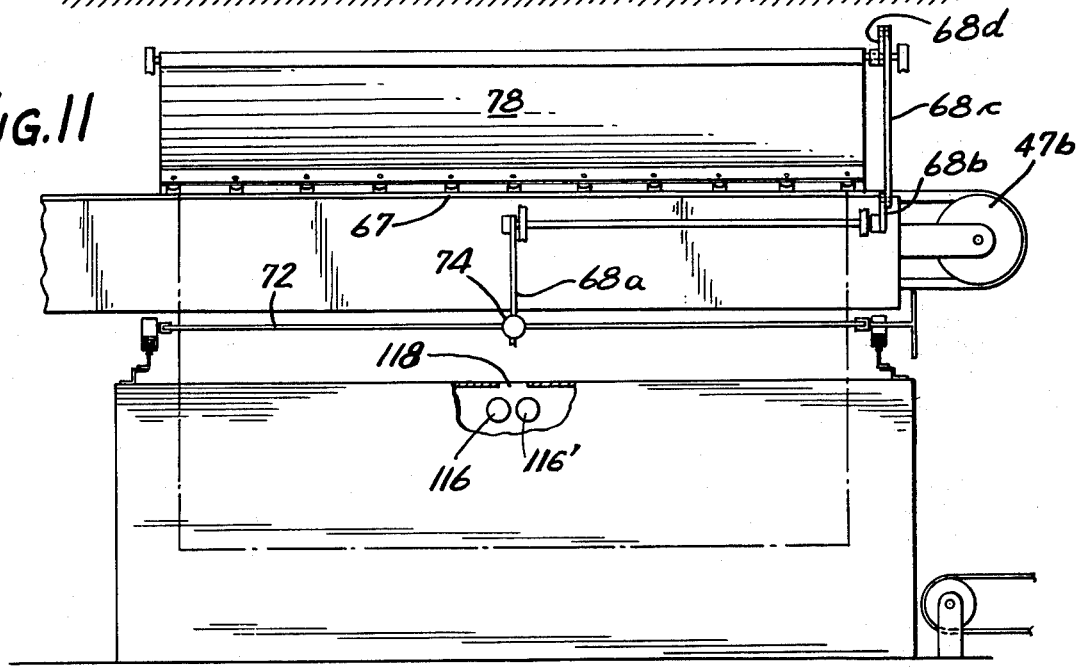
FIG. 11 is an end elevational view, partly broken away, of the folding unit shown in FIG. 10.

When the clamping unit 80 is initially moved against a sensing switch S8 and S8′, a solenoid control valve 115′ is operated to activate an air or hydraulic cylinder 114 controlling a cross-folding blade 110 (see FIGS. 10–11) carried by a piston rod 112 extending from the cylinder 114, to effect downward movement of the folding blade 110. This movement of the blade 110 presses the piece of sheet material involved through a slot 118 in a table 114 of the folding unit 8, upon which table the piece of sheet material is dropped when released by the clamping unit 80. The sheet material involved is then pressed between two oppositely rotating rollers 116–116′ which forms a cross fold in the sheet material involved. The folding unit 8 may have other cross folding elements (not shown) located therein, to finally produce a folded product of the ultimately desired size, which is delivered to a discharge opening 120 in the folding unit 8, where it passes upon an outlet conveyor 10 extending to the packaging station as previously indicated.

It should be understood that the present invention provides an exceedingly efficient and automated sheet material cutting, draping, handling and folding system for manufacturing and folding various sheet products, such as bed sheets, bed spreads, curtains, drapes and the like.

It should be understood that numerous modifications may be made in the exemplary form of the invention described without deviating from the broader aspects of the invention.

I claim:

1. In combination, a draping conveyor having a narrow upper margin over which individual flatwork pieces can be draped in longitudinally spaced relation with at least the lower portions thereof exposed, a sewing station positioned opposite a section of said draping conveyor, and a pair of sewing machines on the opposite lateral sides of said draping conveyor at said sewing station and positioned so that operators in front of said sewing machine may grasp respectively the two exposed portions of the flatwork piece hanging down from the upper margins of said draping conveyor.

2. The combination of claim 1 wherein there is provided flatwork piece draping means for sequentially placing individual flatwork pieces on the upper margins of the conveyor so each flatwork piece has a fold at one end thereof and the portions thereof on opposite sides of the fold hang down from the upper margin of the conveyor where such portions are exposed, said flatwork piece draping means draping each flatwork piece over the upper margins of the conveyor so the fold therein is located on one side of the conveyor and said portions thereof extending from the fold extend around the upper margins of the conveyor and hang down therefrom on the opposite side thereof.

3. The combination of claim 1 wherein there is provided flatwork piece draping means for sequentially placing individual flatwork pieces on the upper margins of the conveyor so each flatwork piece has a fold at one end thereof and the portions thereof on opposite sides of the fold hang down from the upper margin of the conveyor where such portions are exposed, said flatwork piece draping means including flatwork piece feeding means extending generally to a draping station at a point elevated from the upper margins of said draping conveyor where it drops the leading edge portion of a flatwork piece below one side of the upper margins of said draping conveyor, and flatwork piece engaging means for positioning a portion of the flatwork piece which has been dropped on one side of the upper margin of said draping conveyor to the other side of the draping conveyor while the feeding means continues to operate to form a fold therein.

4. The combination of claim 3 wherein said flatwork piece engaging means has a first position where it pushes said portion of said flatwork piece to said other side of the draping conveyor and a second position which permits the end portion of the flatwork piece which has been folded on said other side of said draping conveyor to once again drop on said one side of the draping conveyor, so there are formed confronting engaging portions of the flatwork piece involved.

5. The combination of claim 4 wherein there is combined with the flatwork piece handling apparatus flatwork piece severing means movable in a direction transverse to the direction of movement of said flatwork piece feeding means, said flatwork piece severing means being operable to move from one side to the other of said feeding means to the other of said feeding means to sever a complete flatwork piece from the portion behind the same, sensing means responsive to a given position of the flatwork piece adjacent to said drapery conveyor for effecting the stoppage of said feeding means and the initiation of the movement of said flatwork piece severing means across the flatwork piece and sensing means responsive to the completion of the severance operation for effecting the operation of said feeding means again.

6. The combination of claim 1 wherein there is provided flatwork piece draping means for sequentially placing individual flatwork pieces on the upper margins of the conveyor so each flatwork piece has a fold at one end thereof and the portions thereof on opposite sides of the fold hang down from the upper margin of the conveyor where such portions are exposed, said flatwork piece draping means including flatwork piece feeding means extending generally to said draping station at a point elevated from the upper margins of said draping conveyor where it delivers the same to said draping conveyor, and flatwork piece severing means movable in a direction transverse to the direction of movement of said flatwork piece feeding means, said flatwork piece severing means being operable to move from one side to the other of said feeding means to sever a complete flatwork piece from the portion behind the same, sensing means responsive to a given position of the flatwork piece adjacent to said draping conveyor for effecting the stoppage of said feeding means and the initiation of the movement of said flatwork piece severing means across the flatwork piece, and sensing means responsive to the completion of the severance operation for effecting the operation of said feeding means again.

7. The combination of claim 1 wherein there is provided means for immovably holding each flatwork piece with respect to the narrow upper margin of the draping conveyor at said sewing station, whereby each of said portions of each flatwork piece hanging down from said upper margins of said draping conveyor can swing freely of the other of same for a limited distance with assurance that the position of the upper portion of the draped sheet will not be disturbed.

8. The combination of claim 1 wherein there is provided means for imparting intermittent movement to said draping conveyor so the flatwork pieces are sequentially carried from said draping station to said sewing station, and sensing means at said sewing station for initiating movement of said draping conveyor after both of said portions of said flatwork pieces have been moved a given distance through said sewing machines.

9. The combination of claim 1 further combined with a flatwork sheet folding station at a point beyond the sewing station, the folding station having means for engaging said exposed portions of the flatwork pieces delivered thereto and forming a fold therein in a direction parallel to the fold formed by the draping of the flatwork piece on said draping conveyor.

10. In combination, a pair of draping conveyors each having a narrow upper margin over which individual flatwork pieces can be draped at draping stations in longitudinally spaced relation in a manner where each flatwork piece has a fold at one end thereof with portions thereof on opposite sides of the fold hanging down from the upper margins of the associated draping conveyor where such portions are exposed; a folding machine for folding flatwork pieces fed thereto, the folding machine having a pair of inlet stations at which flatwork pieces on said draping conveyors are respectively delivered, and flatwork piece receiving and folding means for respectively receiving and folding at least once the flatwork pieces delivered to said inlet stations and feeding them to a common outlet station; and a separate sewing station between each of said draping stations and the associated inlet station of said folding machine, each sewing station including a pair of sewing machines on opposite sides of said draping conveyor thereat, said sewing machines being positioned so that operators in front of said sewing machine may grasp respectively the two exposed portions of the flatwork piece hanging down from the upper margins of said draping conveyor.

* * * * *